US011761047B2

(12) United States Patent
Krausa et al.

(10) Patent No.: US 11,761,047 B2
(45) Date of Patent: Sep. 19, 2023

(54) SUSPENSION DEVICE FOR A CONVERTER

(71) Applicant: SMS group GmbH, Düsseldorf (DE)

(72) Inventors: Steffen Krausa, Pittsburgh, PA (US); Christian Osterloh, Ascheberg (DE); William Todd Zeisler, Mars, PA (US)

(73) Assignee: SMS group GmbH, Düsseldorf (DE)

( * ) Notice: Subject to any disclaimer, the term of this patent is extended or adjusted under 35 U.S.C. 154(b) by 0 days.

(21) Appl. No.: 17/537,329

(22) Filed: Nov. 29, 2021

(65) Prior Publication Data

US 2023/0032960 A1 Feb. 2, 2023

Related U.S. Application Data

(60) Provisional application No. 63/226,273, filed on Jul. 28, 2021.

(51) Int. Cl.
*C21C 5/46* (2006.01)
*C21C 5/50* (2006.01)

(52) U.S. Cl.
CPC ..... *C21C 5/4633* (2013.01); *C21C 5/50* (2013.01)

(58) Field of Classification Search
CPC ..... C21C 5/4633
See application file for complete search history.

(56) References Cited

U.S. PATENT DOCUMENTS

2015/0152514 A1 6/2015 Poloni et al.
2023/0032960 A1* 2/2023 Krausa ..... C21C 5/50

FOREIGN PATENT DOCUMENTS

| | | | |
|---|---|---|---|
| CN | 201272819 | Y | 7/2009 |
| CN | 201301324 | Y | 9/2009 |
| CN | 204198783 | U | 3/2015 |
| CN | 205077091 | U | 3/2016 |
| DE | 1903685 | C2 | 7/1975 |
| EP | 1211328 | A3 | 12/2003 |
| EP | 2956559 | B1 | 1/2017 |
| EP | 2852692 | B1 | 7/2017 |
| KR | 101675262 | B1 * | 11/2016 |
| WO | 9118119 | A1 | 11/1991 |
| WO | 2009074044 | A1 | 6/2009 |

* cited by examiner

*Primary Examiner* — Scott R Kastler
(74) *Attorney, Agent, or Firm* — Smartpat PLC

(57) ABSTRACT

A converter includes a container and a supporting ring. A suspension device for the converter has a central structure fixed to the container. A first lateral structure is arranged at a first side of the central structure and fixed to a surface of the supporting ring. A second lateral structure is oppositely arranged. First and second sliding blocks are respectively connected with the first and second lateral structure. A first contact body is connected with the central structure by a first threaded bolt which engages a threaded hole in the central structure and a threaded hole in the first contact body. A second contact body is connected with the central structure by a second threaded bolt which engages a threaded hole in the central structure and a threaded hole in the second contact body. A distance element is arranged between the central structure and the first and/or second contact body.

12 Claims, 5 Drawing Sheets

SUSPENSION DEVICE FOR A CONVERTER

TECHNICAL FIELD

The disclosure relates to a suspension device for a converter as used in basic oxygen steelmaking.

BACKGROUND

In steelmaking, an oxygen converter is used to convert cast iron produced in a blast furnace into raw liquid steel. A suspension device for tilting oxygen converters is disclosed in EP 2 852 692 B1. The container of the converter must be carried by the supporting ring, wherein also a center function must be given for the tilting converter container. Thereby, measures must be taken to allow the compensation due to thermal expansions. At the other side, clearance between the container and the supporting ring should be avoided. So, overloads in the interface zone between the part of the device fixed to the container and the parts of the device fixed to the supporting ring should be avoided. At this pre-known solution wedge-shaped elements are employed to fulfil this requirement. Detrimentally, the design is relatively complex and thus costly.

Similar and other pre-known solutions are shown in EP 1 211 328 A2, in EP 2 956 559 B1, in WO 91/18119 A1, in WO 2009/074044 A1, in CN 205077091 U, in CN 201301324 Y, in CN 201272819 Y and in CN 204198783 U.

By the mentioned solution it is possible to eliminate angular deflections or misalignments. Also sliding in the vertical and horizontal direction between the central structure and the lateral structures is allowed which can be necessary due to a thermal expansion of the arrangement over the time.

Detrimentally, the known solutions require a plurality of parts and are thus expensive. Also, the maintenance is quite complex and expensive.

SUMMARY

The disclosure relates to an improved suspension device for a converter which overcomes the mentioned drawbacks by keeping the full required functionality of the arrangement. The converter comprises a container and a supporting ring. The suspension device comprises a central structure which is fixed to the container, a first lateral structure which is arranged at a first side of the central structure and which is fixed to a surface of the supporting ring and a second lateral structure which is arranged at a second side of the central structure and which is fixed to a surface of the supporting ring.

The disclosed simplified design requires fewer components. The assembly becomes easier and the maintenance effort and time are reduced. Also, it is aimed for an easy possibility to adjust the suspension during and after the assembly process.

This is achieved in that the suspension device further comprises a first sliding block which is connected with the first lateral structure and faces the central structure. A second sliding block is connected with the second lateral structure and faces the central structure. A first contact body is connected with the central structure and faces the first sliding block. The first contact body is connected with the central structure by a first threaded bolt which engages with a threaded hole which is machined into the central structure and a threaded hole which is machined into the first contact body.

A second contact body is connected with the central structure and faces the second sliding block. The second contact body is connected with the central structure by a second threaded bolt which engages with a threaded hole which is machined into the central structure and a threaded hole which is machined into the second contact body.

At least one distance element is arranged between the central structure and the first contact body and/or between the central structure and the second contact body.

The threaded bolts are preferably rounded in their axial end regions.

The contact bodies have preferably a polygonal outer circumference, especially a hexagonal outer circumference. By doing so it is easy to assemble the contact bodies to the central structure.

The first threaded bolt and the second threaded bolt are preferably arranged coaxially.

The at least one distance element has preferably a disc-shaped design. Furthermore, for an easy assembly and disassembly it can be provided that at least one of the distance elements has a radially extending slit. By this it becomes very easy to add or to retrace a distance element from the gap between the central structure and the contact body during assembly and adjustment of the device.

The thickness of the distance element is preferably between 1 mm and 50 mm, and specifically preferred between 5 mm and 15 mm.

The contact body can slide in a vertical and horizontal direction along the sliding block and thereby accommodate thermal expansion of the container and supporting ring. The sliding block and the contact body which faces the sliding block have preferably a non-flat surface, wherein the surfaces of the sliding block and the contact body are preferably designed complementary. In one case it can be provided that the sliding block has a convex surface and the contact body has a concave surface. Also, the other possibility is given, i.e. that the sliding block has a concave surface and the contact body has a convex surface.

The proposed concept of the suspension device has a simple design and thus only few components. The assembly and the adjustment of the components becomes thus quite easy which saves cost and time. Also, a good accessibility to the suspension device is given; this is beneficial for maintenance work on the system.

The adjustment of the required clearance becomes very easy and can be done in a short time; this applies for the assembly as well as in the case of the maintenance of the device.

Compared with the pre-known solution the full functionality of the suspension device is guaranteed.

The following detailed description is merely exemplary in nature and is not intended to limit the invention or the application and uses of the invention. Furthermore, there is no intention to be bound by any theory presented in the preceding background or the following detailed description.

DETAILED DESCRIPTION

Figure 1:
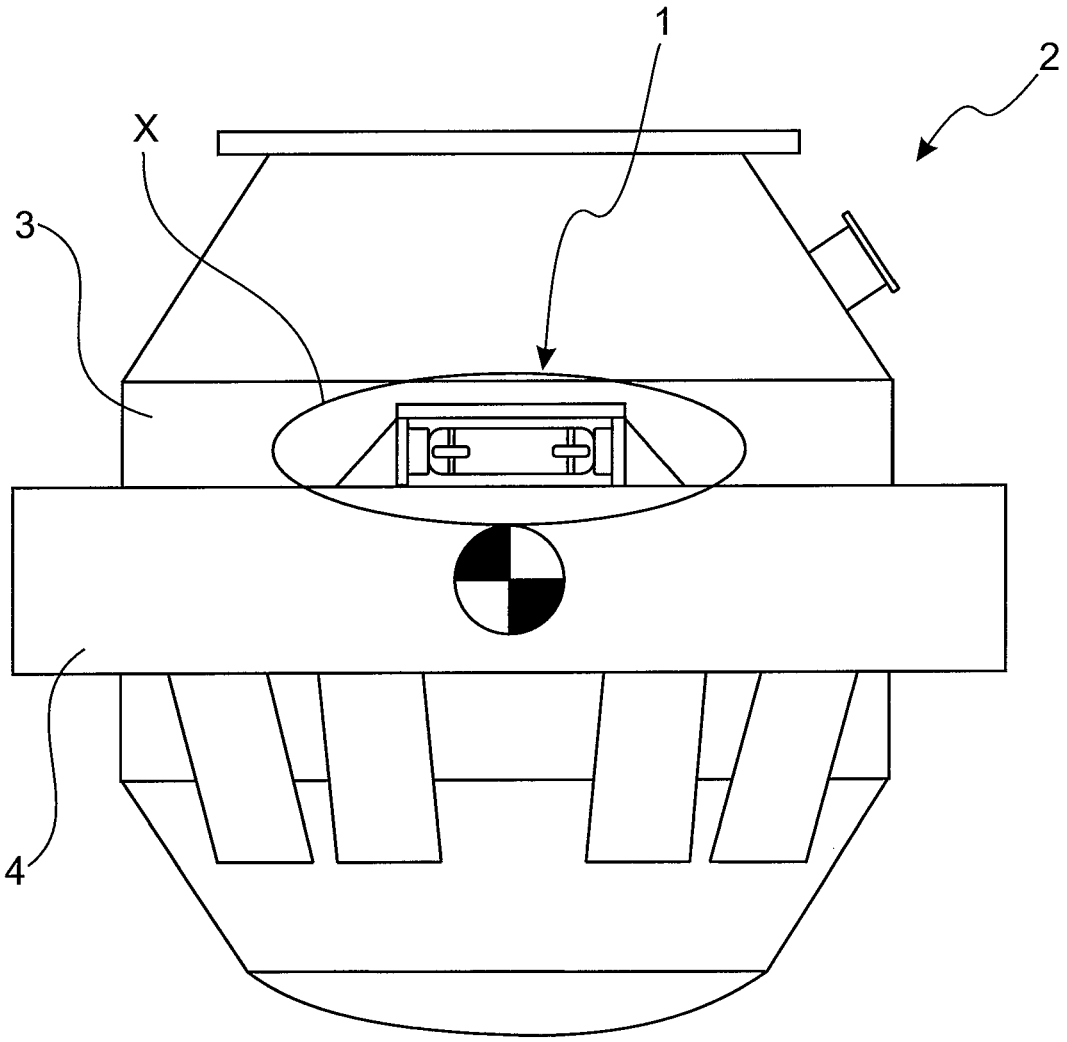
FIG. 1 shows a side view of a converter with a container and a supporting ring as well as a suspension device for carrying the container by the supporting ring.
Figure 2:
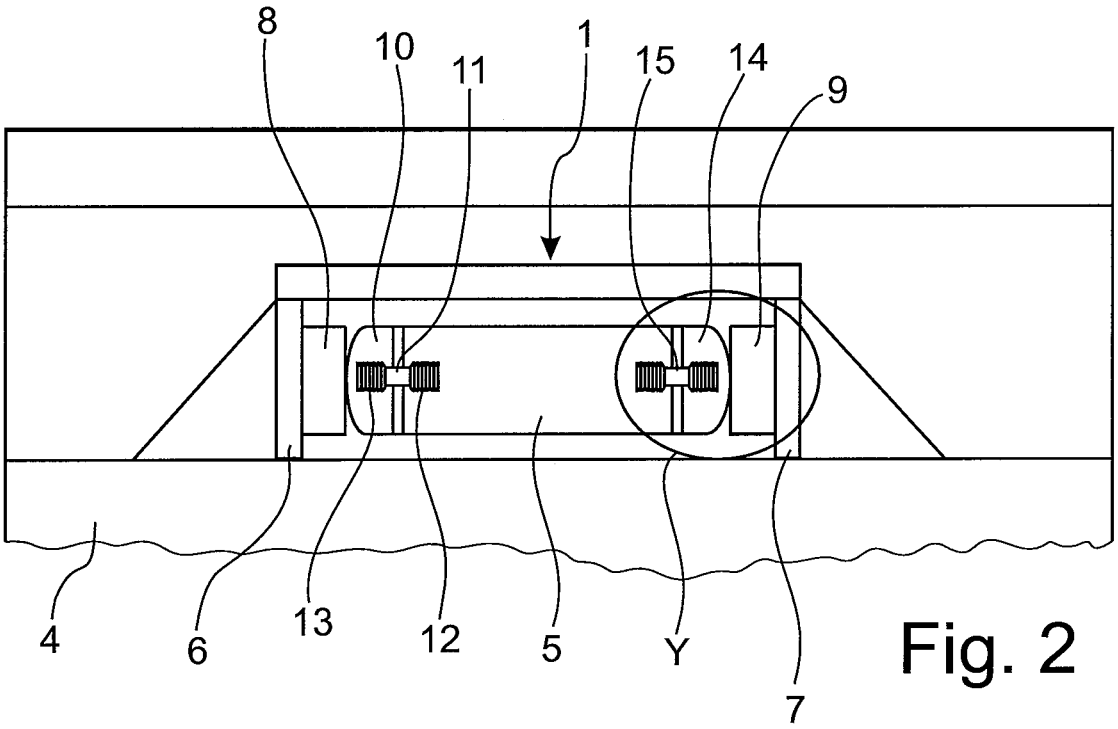
FIG. 2 shows the detail "X" according to FIG. 1.
Figure 3:
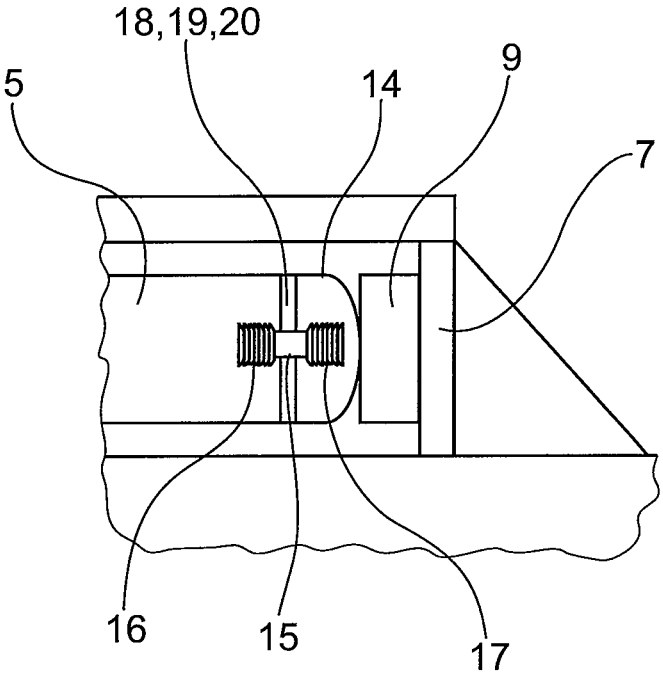
FIG. 3 shows the detail "Y" according to FIG. 2.
Figure 4:
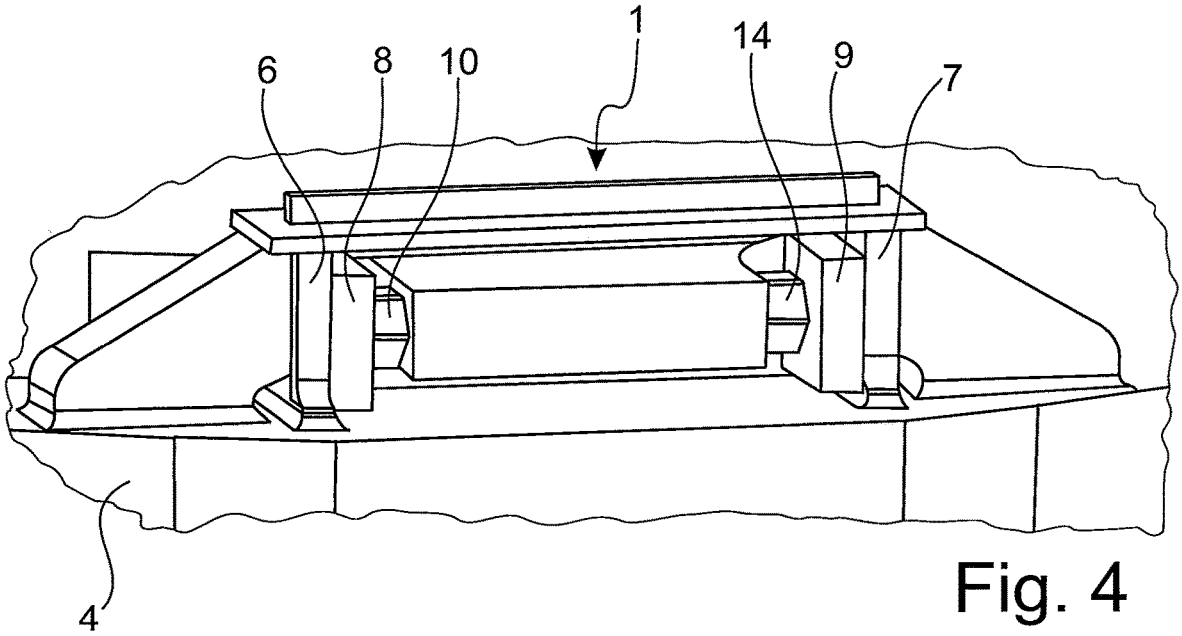
FIG. 4 shows a perspective view of the suspension device.
Figure 5:
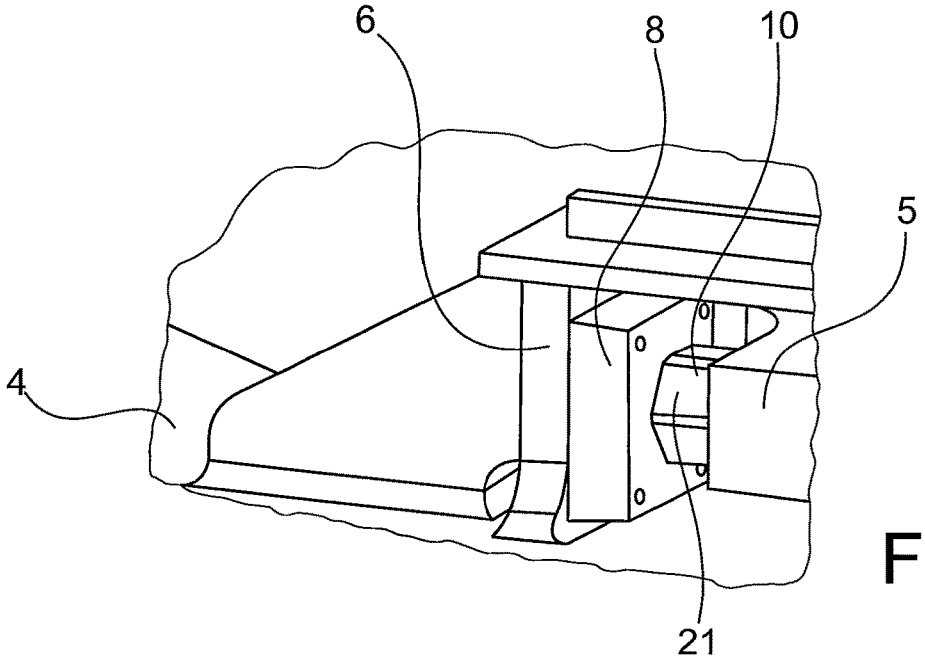
FIG. 5 shows a perspective view of one end of the suspension device.
Figure 6:
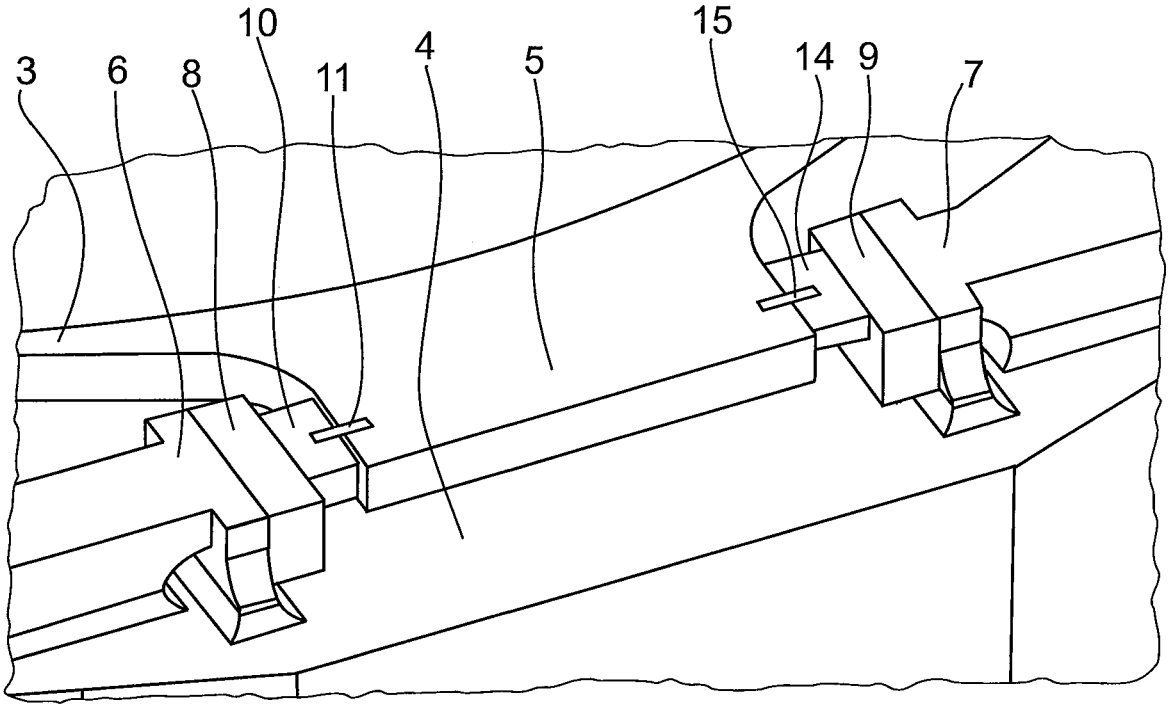
FIG. 6 shows a perspective sectional view of the suspension device, cut in a first plane.
Figure 7:
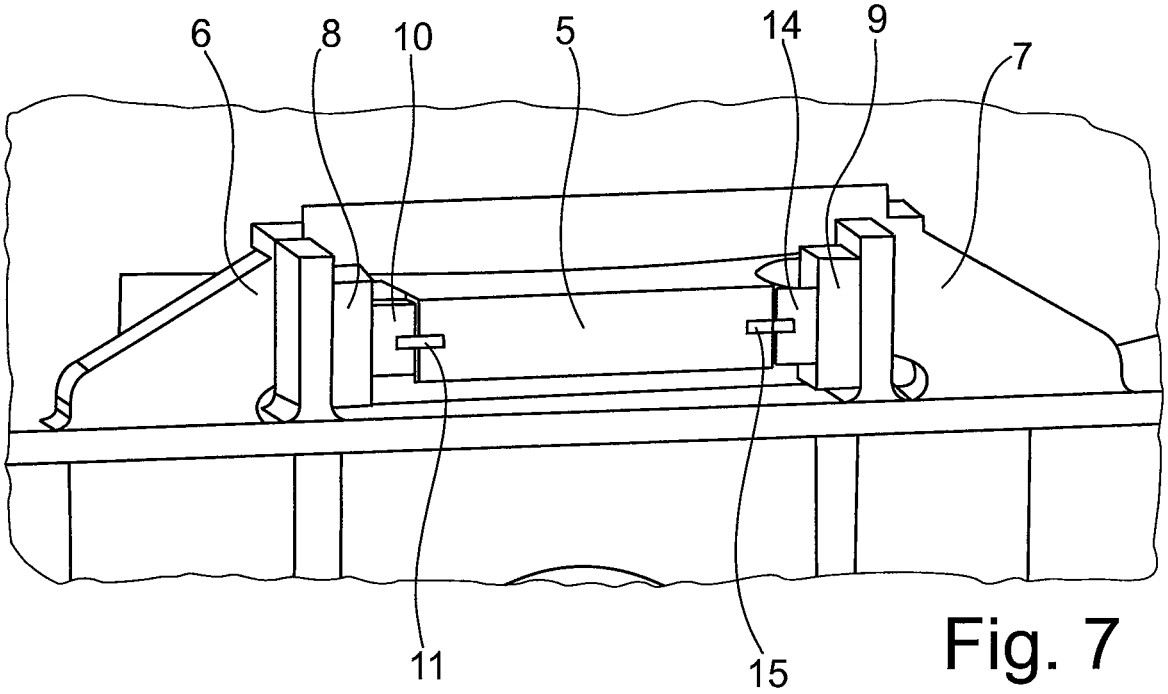
FIG. 7 shows another perspective sectional view of the suspension device, cut in a plane perpendicular to the first plane.
Figure 8:
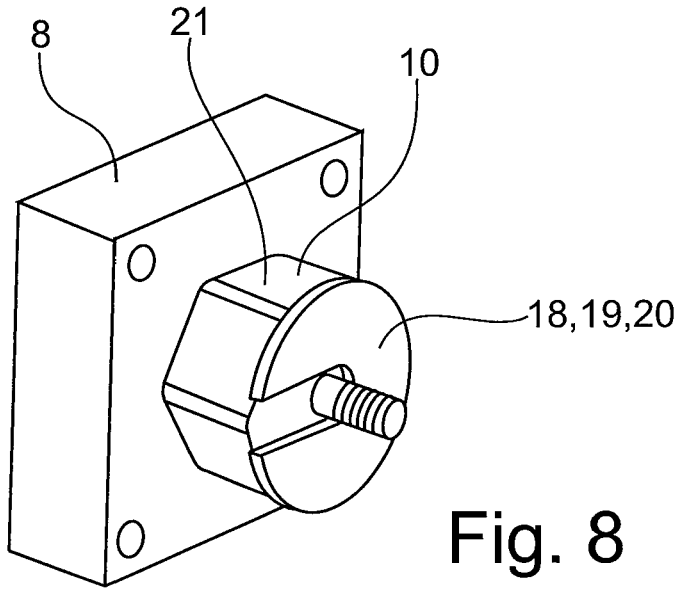
FIG. 8 shows a perspective view of a sliding block and a contact body together with a distance element.
Figure 9:
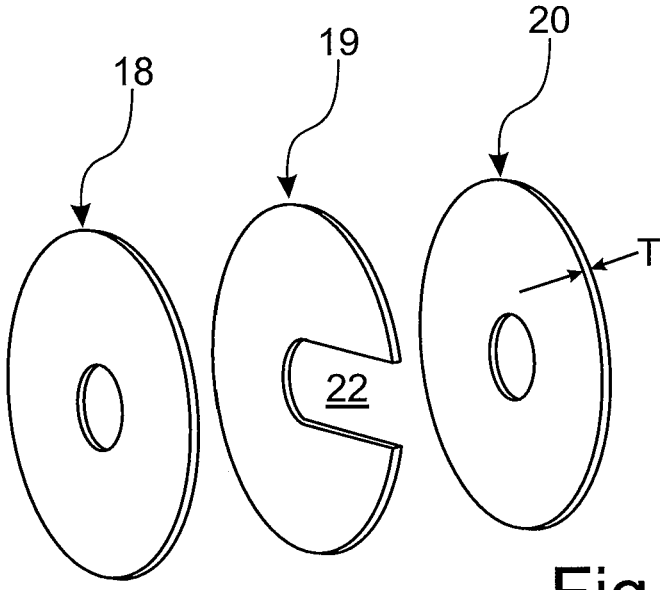
FIG. 9 shows a perspective view of three distance elements.

FIG. 1 shows a converter 2 which consists substantially of a container 3 and a supporting ring 4 which holds the container 3. With regard to the technological background of such a converter reference is made to EP 1 211 328 A2 filed by the patent applicant which is hereby incorporated by reference thereto in its entirety.

The container 3 is supported relatively to the supporting ring 4 by a suspension device 1. More specifically, two of such suspension devices 1 are arranged at two opposing locations of the container 3 and supporting ring 4 respectively.

The specific design of the suspension device 1 can be seen from FIGS. 2 to 9 where details of the same are depicted.

The suspension device 1 has a central structure 5 which is firmly connected with the container 3. The supporting ring 4 has two lateral structures 6 and 7, namely a first lateral structure 6 and a second lateral structure 7.

For a safe operation of the converter 2 it is important that the extension of the central structure 5 fits precisely with the distance which is defined between the two lateral structures 6 and 7.

For doing so the following design is provided.

A first sliding block 8 is connected with the first lateral structure 6; the sliding block 8 faces the central structure 5. Also, a second sliding block 9 is connected with the second lateral structure 7; the sliding block 9 faces also the central structure 5. The mentioned connection can be a screw connection.

The central structure 5 comprises two contact bodies 10 and 14.

More specifically, the first contact body 10 is connected with the central structure 5 and is facing the first sliding block 8. Thereby, the first contact body 10 is connected with the central structure 5 by a first threaded bolt 11 which engages with a threaded hole 12 which is machined into the central structure 5 and a threaded hole 13 which is machined into the first contact body 10.

Analogously, the second contact body 14 is also connected with the central structure 5 and is facing the second sliding block 9. The second contact body 14 is connected with the central structure 5 by a second threaded bolt 15 which engages with a threaded hole 16 which is machined into the central structure 5 and a threaded hole 17 which is machined into the second contact body 14.

Furthermore, distance elements 18, 19 and 20 are provided. At least one of those distance elements 18, 19, 20 is arranged between the central structure 5 and the first contact body 10 and between the central structure 5 and the second contact body 14.

The distance elements 18, 19, 20 can be disk-shaped as depicted. A preferred embodiment provides that the distance element—see distance element 19 in FIG. 9—has a radial extending slit 22. This allows that the distance element is mounted or disassembled without total disassembly of the contact body 10, 14 by radial insertion or radial extraction of the distance element after loosening the screw connection between the contact body 10, 14 and the central structure 5.

The thickness T of the distance elements 18, 19 20 is adequately sized to allow an effective adjustment of the effective width of the central structure plus contact bodies 10, 14 to match with minimal clearance with the width between the two lateral structures 6 and 7. A thickness between 2 mm and 10 mm is preferred.

For an easy fastening or loosening of the contact body 10, 14 at the central structure 5 the outer circumference 21 of the contact body 10, 14 is hexagonal for the engagement of a screw wrench.

The surface of the contact bodies 10, 14 is convex at the side facing the respective sliding blocks 8 and 9. The counter-surface of the sliding blocks 8 and 9 can be flat or concave.

During assembly, at first the first and second threaded bolts 11 and 15 are mounted into the threaded holes 12 and 16 of the central structure 5. On the shaft of the threaded bolts 11, 15 the distance elements 18, 19, 20 can be pushed, before the first and second contact bodies 10 and 14 are mounted by the threaded holes 12 and 16 in the contact bodies 10, 14. This arrangement can then be pushed into the space which is defined between the first and second lateral structures 6 and 7.

By using different distance elements 18, 19, 20 the effective extension of the central structure plus contact bodies 10, 14 can be adjusted to fit with the distance between the first and second lateral structures 6 and 7. Specifically, the clearance of the central structure plus contact bodies 10, 14 and the lateral structures 6 and 7 can be eliminated by choosing distance elements 18, 19, 20 of adequate thickness T. By using distance elements 19 with a slit 22 the operation can be carried out in the assembled state of the suspension device 1.

To adjust the connection after setting effects, the pressure bodies 10, 14 can be loosened and pressed against the sliding blocks 8 and 9 once more to replace the distance element by another one with a different thickness T, before retightening the components.

To replace components after wear effects, the sliding blocks 8, 9 can be removed. Afterwards, the contact bodies 10, 14 can be detached with or without the threaded bolts and the distance elements. After the assembly the system needs to be adjusted.

The distance elements protect the contact bodies 10, 14 and the central structure against imprints of the distance elements gaps and create a better force transmission through the components.

While the present invention has been described with reference to exemplary embodiments, it will be readily apparent to those skilled in the art that the invention is not limited to the disclosed or illustrated embodiments but, on the contrary, is intended to cover numerous other modifications, substitutions, variations and broad equivalent arrangements that are included within the spirit and scope of the following claims.

REFERENCE NUMERALS

1 Suspension device
2 Converter
3 Container
4 Supporting ring
5 Central structure
6 First lateral structure
7 Second lateral structure

8 First sliding block
9 Second sliding block
10 First contact body
11 First threaded bolt
12 Threaded hole
13 Threaded hole
14 Second contact body
15 Second threaded bolt
16 Threaded hole
17 Threaded hole
18 Distance element
19 Distance element
20 Distance element
21 Circumference of the contact body
22 Slit
T Thickness

What is claimed is:

1. A suspension device for a converter, wherein the converter comprises a container and a supporting ring, wherein the suspension device comprises:

a central structure which is fixed to the container;

a first lateral structure arranged at a first side of the central structure and fixed to a surface of the supporting ring;

a second lateral structure arranged at a second side of the central structure and fixed to the surface of the supporting ring;

a first sliding block connected with the first lateral structure and facing the central structure;

a second sliding block connected with the second lateral structure and facing the central structure;

a first contact body which is connected with the central structure and faces the first sliding block, wherein the first contact body is connected with the central structure by a first threaded bolt which engages with a threaded hole which is machined into the central structure and a threaded hole which is machined into the first contact body;

a second contact body which is connected with the central structure and faces the second sliding block, wherein the second contact body is connected with the central structure by a second threaded bolt which engages with a threaded hole which is machined into the central structure and a threaded hole which is machined into the second contact body; and at least one distance element arranged between the central structure and the first contact body and/or between the central structure and the second contact body, wherein the first contact body can slide along the first sliding block and the second contact body can slide along the second sliding block to thereby accommodate thermal expansion of the container and the supporting ring.

2. The suspension device according to claim 1, wherein the first threaded bolt and the second threaded bolt are each rounded in a respective axial end region.

3. The suspension device according to claim 1, wherein the first contact body and the second contact body each have a polygonal outer circumference.

4. The suspension device according to claim 1, wherein the first contact body and the second contact body each have a hexagonal outer circumference.

5. The suspension device according to claim 1, wherein the first threaded bolt and the second threaded bolt are arranged coaxially.

6. The suspension device according to claim 1, wherein the at least one distance element is disc-shaped.

7. The suspension device according to claim 6, wherein the at least one distance element has a radially extending slit.

8. The suspension device according to claim 6, wherein a thickness of the distance element is between 1 mm and 50 mm.

9. The suspension device according to claim 6, wherein a thickness of the distance element is between 5 mm and 15 mm.

10. The suspension device according to claim 1, wherein the first sliding block and the first contact body which faces the first sliding block each have a non-flat surface, and wherein the second sliding block and the second contact body which faces the second sliding block each have a non-flat surface, wherein the surfaces of the first sliding block and the first contact body are designed complementary and wherein the surfaces of the second sliding block and the second contact body are designed complementary.

11. The suspension device according to claim 10, wherein the first sliding block has a convex surface and the first contact body has a concave surface.

12. The suspension device according to claim 10, wherein the first sliding block has a concave surface and the first contact body has a convex surface.

* * * * *